US007325422B2

(12) United States Patent
Seo et al.

(10) Patent No.: US 7,325,422 B2
(45) Date of Patent: Feb. 5, 2008

(54) WASHING METHOD OF DRUM TYPE WASHING MACHINE

(75) Inventors: Hyun-Seok Seo, Incheon (KR); Byung-Keol Choi, Gyeonggi-Do (KR); Tae-Hee Lee, Seoul (KR); Sang-Wook Hong, Seoul (KR); Si-Moon Jeon, Seoul (KR)

(73) Assignee: LG Electronics Inc., Seoul (KR)

( * ) Notice: Subject to any disclaimer, the term of this patent is extended or adjusted under 35 U.S.C. 154(b) by 721 days.

(21) Appl. No.: 10/756,377

(22) Filed: Jan. 14, 2004

(65) Prior Publication Data

US 2004/0158933 A1 Aug. 19, 2004

(30) Foreign Application Priority Data

Feb. 14, 2003 (KR) ..... 10-2003-0009493

(51) Int. Cl.
*B06B 33/02* (2006.01)

(52) U.S. Cl. ..... 68/12.02; 68/12.04; 8/159

(58) Field of Classification Search ..... 68/12.02, 68/12.04; 8/159
See application file for complete search history.

(56) References Cited

U.S. PATENT DOCUMENTS 5,335,524 A * 8/1994 Sakane ..... 68/12.04
5,870,905 A * 2/1999 Imamura et al. ..... 68/12.04
5,890,247 A * 4/1999 Erickson et al. ..... 8/158

FOREIGN PATENT DOCUMENTS

| | | | |
|---|---|---|---|
| CN | 1167851 | A | 12/1997 |
| EP | 0 806 513 | A2 | 11/1997 |
| EP | 1 354 997 | A | 10/2003 |
| GB | 2 253 215 | A | 9/1992 |
| JP | 08-299658 | A | 11/1996 |

* cited by examiner

*Primary Examiner*—Michael Barr
*Assistant Examiner*—Saeed Chaudhry
(74) *Attorney, Agent, or Firm*—Birch, Stewart, Kolasch & Birch, LLP

(57) ABSTRACT

In a washing method of a drum type washing machine, a large amount of the laundry can be more effectively washed by effectively transmitting a mechanical force to the laundry by repeatedly and forcedly rotating a drum forward (or clockwise) or backward (or counterclockwise) for a short predetermined time. Through continuous rotation of the drum of the drum type washing machine, a falling washing is performed such that the laundry in the drum is washed by falling by a gravity, or a reversing washing is performed such that the laundry is washed by repeatedly rotating the drum forward (or clockwise) or backward (or counterclockwise) for a short predetermined time, thereby improving energy efficiency through economizing a washing time and washing water according to the amount of the laundry, and also preventing a waste of power by driving a heater at a proper time.

20 Claims, 4 Drawing Sheets

WASHING METHOD OF DRUM TYPE WASHING MACHINE

This Non-provisional application claims priority under 35 U.S.C. § 119(a) on patent application Ser. No. 10-2003-0009493 filed in Korea on Feb. 14, 2003, the entire contents of which are hereby incorporated by reference.

BACKGROUND OF THE INVENTION

1. Field of the Invention

The present invention relates to a drum type washing machine, and particularly, to a washing method of a drum type washing machine capable of performing washing more effectively by forward (or clockwise) and backward (or counterclockwise) rotating a drum of a washing machine for a short time.

2. Description of the Background Art

In general, a drum type washing machine can reduce a volume of a washing machine itself compared to a pulsator washing machine in which a drum rotates erected, can receive a greater amount of the laundry, and can reduce problems such as the entangled laundry, or the like. For these reasons, a demand of a drum type washing machine is being gradually increased.

FIG. 1 is a front view illustrating an internal structure of a general drum type washing machine.

FIG. 2 is an exemplary view illustrating a washing direction of a general drum type washing machine.

As shown in FIG. 1, a general drum type washing machine includes a tub 11 fixed inside a main body 10 of a washing machine; a pump 18 mounted at a base plate positioned at a lower end of the main body 10; a first drain hose 16 formed at a lower portion of the tub 11, and for draining washing water in the drum 14 in drainage; a second drain hose 19 formed at an upper portion of the pump 18, and for discharging washing water outside the main body 10; a drum 14 rotated in the tub 11 to wash the laundry; a plurality of lifters 15 formed inside the drum 14, and on which the laundry is hung so that the laundry ascends and then falls in a degree in rotation of the drum 14; a drum driving motor 12 receiving power applied thereto from the outside to be driven; a belt 13 connected with the drum driving motor 12 to transmit a driving force for rotating the drum forward (or clockwise) or backward (or counterclockwise) to the drum; and a control part (not shown) formed at a certain region in the main body 10, and for controlling a load of the drum driving motor 12 or the like in the drum type washing machine.

Operations of the drum type washing machine according to the conventional art constructed as above will now be described.

First, the laundry is put into the drum 14, and then a wash mode provided at the control part is selected. Thereafter, as shown in FIG. 2, water is supplied by the control of the control part, and a washing operation is performed by rotating the drum 14 forward (or clockwise) or backward (or counterclockwise) in only one direction with about 50 RPM by the drive of the drum driving motor 12. That is, in rotation of the drum 14, the laundry ascends hung on the lifters 15 in the drum 14, and then freely falls at a certain point of time, to bump against washing water and an inner surface of the drum 14, and these operations are repeated. When the above washing operation is completed, rinsing is performed passed through the same process as that in washing operation. Thereafter, when the rinsing operation is completed, the pump 18 mounted at the base plate 17 is operated so that washing water used for washing drains through the first drain hose 16 and is discharged to the outside through the second drain hose 19, and the drum 14 is rotated at a high speed by high-speed rotation of the drum driving motor 12, thereby performing dewatering.

However, because the laundry ascends and falls to perform washing, the conventional drum type washing machine operated as above cannot perform effective washing in case of washing a large amount of the laundry in the drum. That is, in case of washing a large amount of the laundry, mechanical washing effect generated when the laundry is washed beaten is little, and a washing only by detergent is performed, thereby degrading washing performance. In addition, in order to increase washing effect by the detergent, washing water is increased in quantity, thereby increasing a washing time and washing water in quantity, and thus increasing energy consumption.

SUMMARY OF THE INVENTION

Therefore, an object of the present invention is to provide a washing method of a drum type washing machine capable of effectively washing a large amount of the laundry by effectively transmitting a mechanical force to the laundry by repeatedly and forcedly rotating a drum forward (or clockwise) or backward (or counterclockwise) for a short predetermined time.

To achieve these and other advantages and in accordance with the purpose of the present invention, as embodied and broadly described herein, there is provided a washing method of a drum type washing machine including performing a falling washing such that the laundry in the drum is washed by falling by a gravity through continuously rotating the drum of the drum type washing machine, or performing a reversing washing such that the laundry is washed by repeatedly rotating the drum forward (or clockwise) or backward (or counterclockwise) for a short predetermined time.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, a preferred embodiment of a washing method of a drum type washing machine capable of improving its washing performance regardless of the amount of the laundry, by washing the laundry with beating in a manner that the laundry ascends and falls by a gravity, and also by repeatedly rotating the drum forward (or clockwise) or backward (or counterclockwise) for a short predetermined time, will now be described in detail with reference to accompanying drawings.

Figure 1:
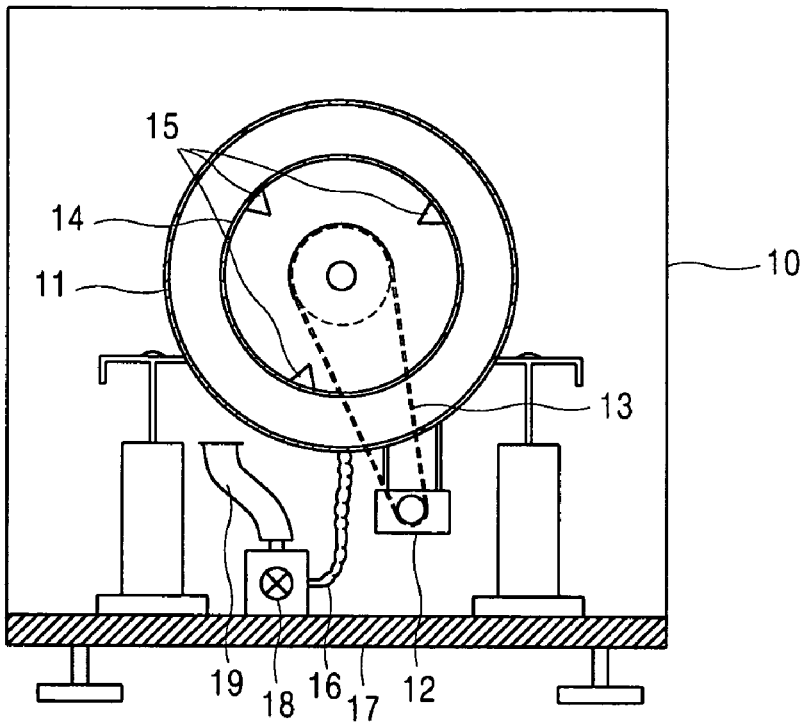
FIG. 1 RELATED ART
FIG. 1 is a front view illustrating an internal structure of a general drum type washing machine.
Figure 2:
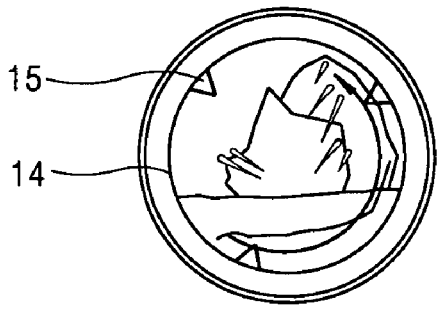
FIG. 2 RELATED ART
FIG. 2 is an exemplary view illustrating a washing direction of a general drum type washing machine.
Figure 3:
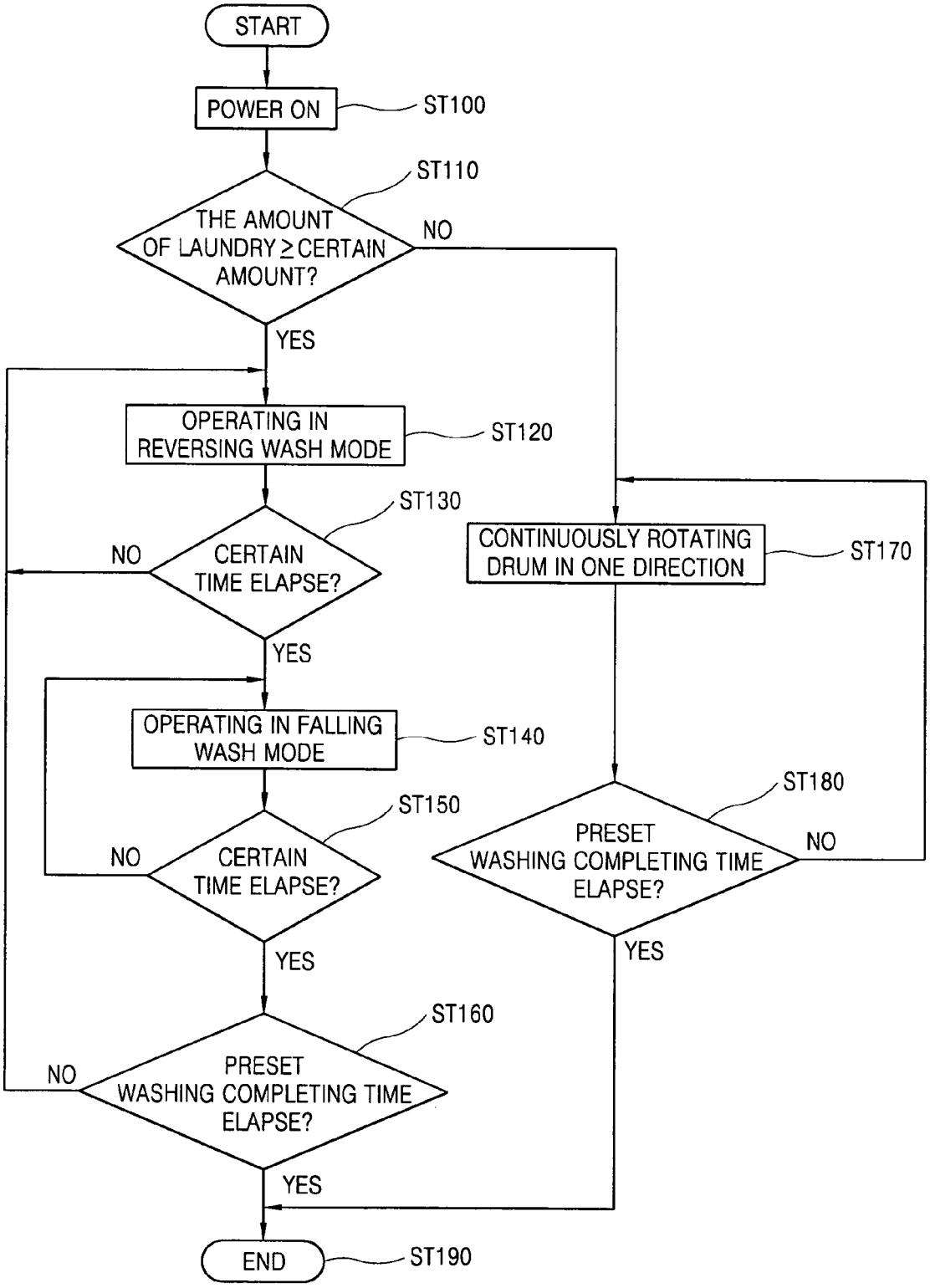
FIG. 3 is a flow chart showing a washing method of a drum type washing machine in accordance with the present invention.

FIG. 3 is a flow chart showing a washing method of a drum type washing machine in accordance with the present invention.

As shown in FIG. 3, a washing method of a drum type washing machine in accordance with the present invention includes the steps of: detecting the amount of the laundry in a drum by turning on power of the drum type washing machine (ST100); if the amount of the laundry is the same as or greater than a certain amount, rotating the drum forward (or clockwise) or backward (or counterclockwise) in a reversing wash mode (ST110, ST 120); after performing washing in the reversing wash mode for a certain time, rotating the drum in one direction in a falling wash mode (ST130, ST140); and after performing washing in the falling wash mode for a certain time, performing washing repeating the operations in said reversing wash mode and said falling wash mode until a preset washing completing time (ST150, ST160). Herein, as a result of said detecting, if the amount of the laundry is smaller than the certain amount, the step of performing a falling washing until the preset washing completing time by rotating the drum in one direction (ST170, ST180) is further included.

A washing method of a drum type washing machine in accordance with the present invention as above will now be described in detail.

First, a washing method of a drum type washing machine which automatically performs washing in a falling wash mode or a reversing wash mode based on the detected amount of the laundry in the drum, will now be described.

By turning on the power of the drum type washing machine, the amount of the laundry in the drum is detected.

If it is detected that the amount of the laundry in the drum is smaller than the preset amount of the laundry, the drum is driven in a falling wash mode in which the laundry ascends and falls in a degree by continuously rotating the drum in one direction. In such a falling wash mode, the laundry ascends and falls through a lifter, to wash the laundry.

But, if it is detected the amount of the laundry in the drum is the same as or greater than the certain amount of the laundry, a reversing washing is performed for a certain time during a preset washing time, and then, a falling washing is performed until a preset washing completing time after the certain time. Since energy is much consumed in the reversing wash mode than in the falling wash mode, in order to improve energy efficiency, the drum is operated in the reversing wash mode for a certain time, and then, is operated in the falling wash mode. To be sure, a user may set the modes so that only a reversing washing can be performed without performing a falling washing.

Figure 4A:
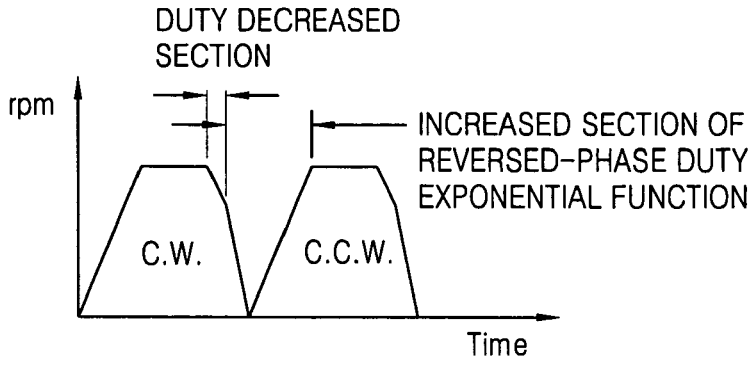
FIG. 4A is a grape illustrating a section in which a duty ratio is increased/decreased according to a washing time in a reversing wash mode of a drum type washing machine in accordance with the present invention.

FIG. 4A is a graph illustrating a section in which a duty ratio is increased/decreased according to a washing time in a reversing wash mode of a drum type washing machine in accordance with the present invention.

Figure 4B:
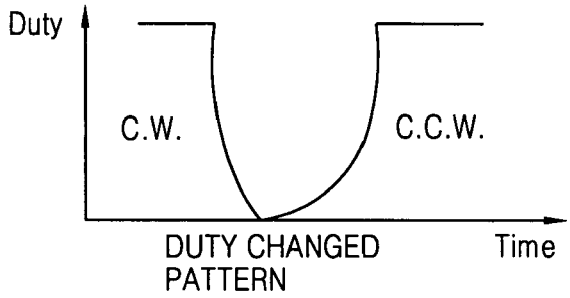
FIG. 4B is a graph illustrating a changed pattern of a duty ratio according to washing time in a reversing wash mode of a drum type washing machine in accordance with the present invention.

FIG. 4B is a graph illustrating a changed pattern of a duty ratio according to a washing time in a reversing wash mode of a drum type washing machine in accordance with the present invention.

Figure 5:
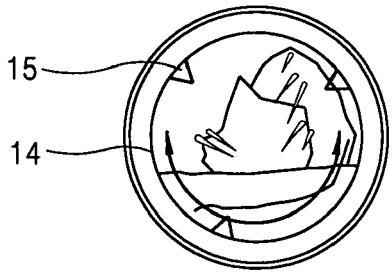
FIG. 5 is an exemplary view illustrating a washing direction of a drum type washing machine which rotates based on a change of an exponent-functional duty ratio in accordance with the present invention.

FIG. 5 is an exemplary view illustrating a washing direction of a drum type washing machine which rotates based on a change of an exponent-functional duty ratio in accordance with the present invention.

First, as shown in FIG. 4A, there is a duty ratio decreased section in the reversing wash mode so that when a constant voltage is applied to a motor, the drum is rotated forward, and after a certain time, a speed of forward (or clockwise) rotation of the drum is reduced. That is, when the drum makes a reverse turn, the force and the direction of the motor which drives the drum are reversed having a continuous predetermined decreased section for a certain time. Herein, the duty ratio decreased section is set in order to prevent stalling of the motor that the motor is stopped or damaged due to a lack of its force when the motor is momentarily and excessively reversed, in case that the rotating direction of the drum is reversed from forward to backward, or from backward to forward. Besides, the duty ratio decreased section is subdivided according to a wash mode selected by a user so as to set a decreased section having multilevel, thereby performing more delicate control as to the rotation of motor.

Thereafter, when the duty ratio decreased section is over, the motor is smoothly stopped by applying an inverse voltage thereto in order to drive the motor, and right after the stop of the motor, the motor rotates the drum backward (or counterclockwise). In order to this, as shown in FIG. 4B, a duty ratio changed pattern of the motor according to the present invention has an exponent functional characteristic, and according to the duty ratio changed pattern, the motor can be driven so that the drum makes a reverse turn at a desired portion. That is, the motor rotates the drum, converting the size and the direction of the force of the motor by increasing/decreasing the duty ratio with the exponent-functional changed pattern. Accordingly, as shown in FIG. 5, a reversing washing can be smoothly performed, reversing a rotation direction of the drum from forward (or clockwise) to backward (or counterclockwise) or from backward (or counterclockwise) to forward (or clockwise) for a predetermined time. In addition, since the duty ratio changed pattern is exponent-functional, there is no need to stop the drive of the motor for a predetermined time to perform a reversing washing, thereby reducing a washing time.

As above, after performing washing in the reversing wash mode, the washing is performed in a falling wash mode in which the laundry ascends and falls in a degree by continuously rotating the drum in one direction. And the reversing washing and the falling washing are repeated a number of times for a certain time until a preset washing time. At this time, in the reversing wash mode and the falling wash mode according to the present invention, preferably, in the reversing washing, a heater for heating washing water is turned off, and in the failing washing, the heater is turned on, thereby effectively performing a washing operation. This is because if the heater is turned on during a reversing washing, power for driving a motor is greatly consumed thereby increasing temporary power consumption, and also because the motor can be protected by eliminating an external variable which is applied to the motor in the reversing washing. In addition, by turning off the heater in the reversing washing, a damage of the laundry, which may occurs when the heater is exposed outside washing water due to big flow of washing water, can be prevented.

On the other hand, a washing method of a drum type washing machine in accordance with the present invention can be constructed so that washing can be performed in a falling wash mode or a reversing wash mode, which is selected by a user.

Figure 6:
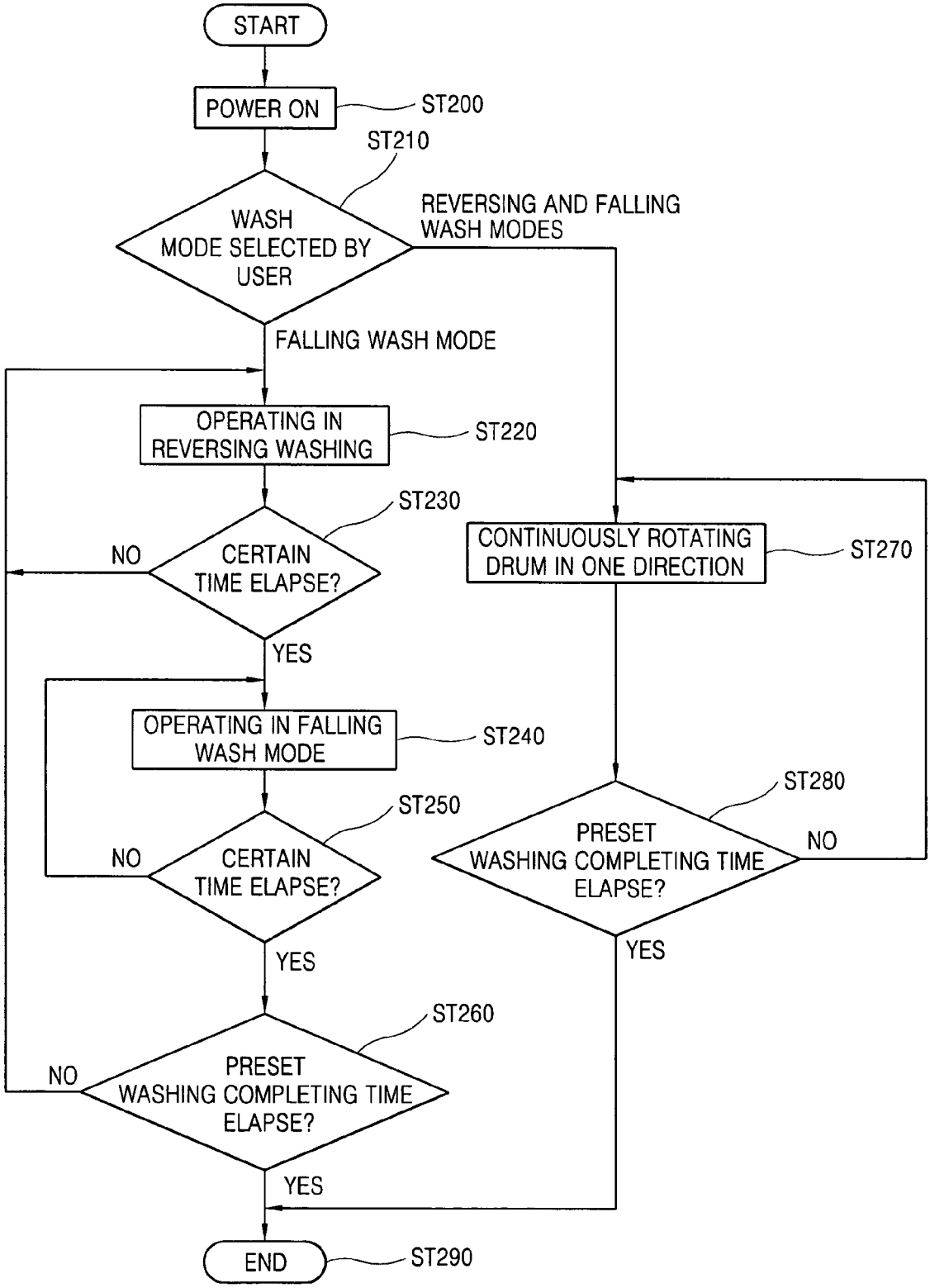
FIG. 6 is a flow chart illustrating another embodiment of a washing method of a drum type washing machine in accordance with the present invention.

FIG. 6 is a flow chart illustrating another embodiment of the present invention of a washing method of a drum type washing machine in accordance with the present invention.

As shown in FIG. 6, a washing method of a drum type washing machine in accordance with the present invention includes the steps of: turning on power of a drum type washing machine, and selecting a wash mode selected by a user (ST200, ST210); if the wash mode is reversing and falling wash modes, rotating the drum forward (or clockwise) and backward (or counterclockwise) in the reversing wash mode (ST220, ST230); after performing washing in the reversing wash mode, rotating the drum in one direction in the falling wash mode (ST240); and after performing washing in the falling wash mode for a certain time, performing washing with repeating the abovementioned operations until a preset washing completing time (ST250, ST260). Herein, in case that the user selects only the falling wash mode, the step of performing a falling washing by rotating the drum in one direction until a preset washing completing time (ST270, ST280) is further included.

Operations of the abovementioned embodiment is the same as those in one embodiment described in FIG. 3, but unlike the one embodiment, in another embodiment, a wash mode is selected by the a user, and thus the operation of the washing machine can be differentiated according to the selection of the user.

A washing method of a drum type washing machine according to the present invention as above will now be described.

First, it is determined whether a user selects both reversing and falling wash modes or selects only a falling wash mode, and then according to the selected wash mode, a washing operation is performed. That is, if a user selects the falling wash mode, the drum is driven in the falling wash mode so that the laundry ascends and falls in a degree by continuously rotating the drum in one direction when a certain voltage is applied to the motor. As described above, such a falling wash mode is a mode in which the laundry ascends and falls through lifters so that the laundry is washed.

On the other hand, if a user selects reversing and falling wash modes, a reversing washing is performed for a predetermined time and then the falling washing is performed.

Lastly, by performing a washing repeating the reversing washing and the falling washing until a preset washing completing time, washing is completed.

As so far described, in the washing method of a drum type washing machine in accordance with the present invention, mechanical washing effect generated when the laundry is washed beaten is excellent since the laundry in the drum falls by gravity, washing performance is excellent regardless of the amount of the laundry by repeatedly rotating the drum forward (or clockwise) or backward (or counterclockwise) for a short predetermined time, and the more laundry can be washed in the drum according to the present invention compared to the existing drum with the same size. In addition, a washing operation can be performed in a wash mode selected according to the amount of the laundry thereby economizing washing time and washing water, and thus improving energy efficiency. In addition, a waste of power can be prevented by driving a heater at a proper time, water consumption can be reduced by using a minimum amount of water, and washing performance can be remarkably improved in a short time compared to the existing washing machine.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A washing method of a drum washing machine, comprising:

a falling washing step which is performed such that the laundry in a drum is washed by falling by gravity through continuous rotation of the drum if the amount of the laundry is smaller than a predetermined amount; and a reversing washing step which is performed such that the laundry is washed by rotating the drum forward or backward for a short predetermined time if the amount of the laundry is greater than or equal to a predetermined amount.

2. The method of claim 1, wherein the falling washing step or the reversing washing step automatically performed.

3. The method of claim 1, wherein when the drum makes a reverse turn, the size and the direction of force of the motor which drives the drum are reversed having a continuous predetermined decreased section for a certain time.

4. The method of claim 1, wherein there is a duty ratio decreased section in the reversing wash mode so that when a constant voltage is applied to a motor, the drum is rotated forward, and, after a certain time, a speed of forward rotation of the drum is reduced.

5. The method of claim 4, wherein the duty ratio decreased section is subdivided into a decrease section having multilevel according to a wash mode selected by a user.

6. The method of claim 4, when the duty ratio decreased section is over, a motor is driven by applying an inverse voltage thereto, and, right after the stop of the motor, the motor rotates the drum backward.

7. The method of claim 6, wherein the duty ratio changed pattern of the motor has an exponent-functional characteristic.

8. The method of claim 6, wherein according to the exponent-functional duty ratio changed pattern of the motor, the duty ratio is increased/decreased, and the size and the direction of the force of the motor are reversed to rotate the drum.

9. The method of claim 1, wherein, in the reversing washing, a heater for heating washing water is turned off.

10. The method of claim 1, wherein, in the falling washing, a heater for heating washing water is turned on.

11. The method of claim 1, wherein, in the reversing washing, a heater for heating washing water is turned off, and, in the falling washing, a heater is turned on to heat washing water.

12. The method of claim 1, wherein the falling washing step or the reverse washing step is selected by a user.

13. The method of claim 12, further comprising:

rotating a drum forward and backward in a reversing wash mode for a certain time when the wash mode is reversing and falling wash modes;

after operating the drum in the reversing wash mode, rotating the drum in one direction in a falling wash mode;

after operating the drum in the falling wash mode for a certain time, performing washing with repeating the abovementioned operations until a preset washing completing time.

14. The method of claim 12, further comprising if a user selects a falling wash mode, performing a falling washing until a preset washing completing time by rotating the drum in one direction.

15. The method of claim 12, wherein the falling washing mode is that the laundry ascends and falls in a degree through a lifter by continuously rotating the drum in one direction.

16. The method of claim 15, wherein if a user selects reversing and falling wash modes, a reversing washing is performed for a certain time, and then, a falling washing is performed for a certain time, and repeatedly performing the falling washing and reversing washing until a preset washing completing time.

17. The method of claim 12, wherein there is a duty ratio decreased section in the reversing wash mode so that when a constant voltage is applied to a motor, the drum is rotated forward, and, after a certain time, a speed of forward rotation of the drum is reduced.

18. The method of claim 17, wherein, when the duty ratio decreased section is over, a motor is driven by applying an inverse voltage thereto, and, right after the stop of the motor, the motor rotates the drum backward.

19. The method of claim 18, wherein the duty ratio changed pattern of the motor has an exponent-functional characteristic.

20. The method of claim 12, wherein, in the reversing washing, a heater for heating washing water is turned off, and, in the falling washing, a heater is turned on to heat washing water.

* * * * *